US008867777B2

(12) United States Patent
Tracy

(10) Patent No.: US 8,867,777 B2
(45) Date of Patent: Oct. 21, 2014

(54) SPEAKER ASSEMBLY

(76) Inventor: Dennis A. Tracy, Culver City, CA (US)

( * ) Notice: Subject to any disclaimer, the term of this patent is extended or adjusted under 35 U.S.C. 154(b) by 338 days.

(21) Appl. No.: 13/402,377

(22) Filed: Feb. 22, 2012

(65) Prior Publication Data

US 2012/0219170 A1 Aug. 30, 2012

Related U.S. Application Data

(60) Provisional application No. 61/445,246, filed on Feb. 22, 2011.

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 1/02*** | (2006.01) |

(52) U.S. Cl.

CPC ..... *H04R 1/025* (2013.01); *H04R 2201/021* (2013.01)

USPC ..... 381/397; 381/395; 381/415; 381/433

(58) Field of Classification Search

USPC ..... 381/332, 386, 395, 397, 412, 433

See application file for complete search history.

(56) References Cited

FOREIGN PATENT DOCUMENTS

JP 53126918 A * 11/1978 ..... H04R 1/02

* cited by examiner

*Primary Examiner* — Matthew Eason

(74) *Attorney, Agent, or Firm* — Welsh Flaxman & Gitler LLC

(57) ABSTRACT

A speaker assembly includes a speaker housing having a substantially closed speaker chamber, the speaker housing including a first wall with a dimple assembly defining a heat sink formed therein. A first driver is mounted and enclosed in the speaker chamber, the first driver including a cone coupled to a driver magnet for generating sound. The driver magnet is in direct contact with the dimple assembly effectively exposing the driver magnet to an exterior of the speaker housing via the heat sink defined by the dimple assembly.

11 Claims, 4 Drawing Sheets

FIG. 2
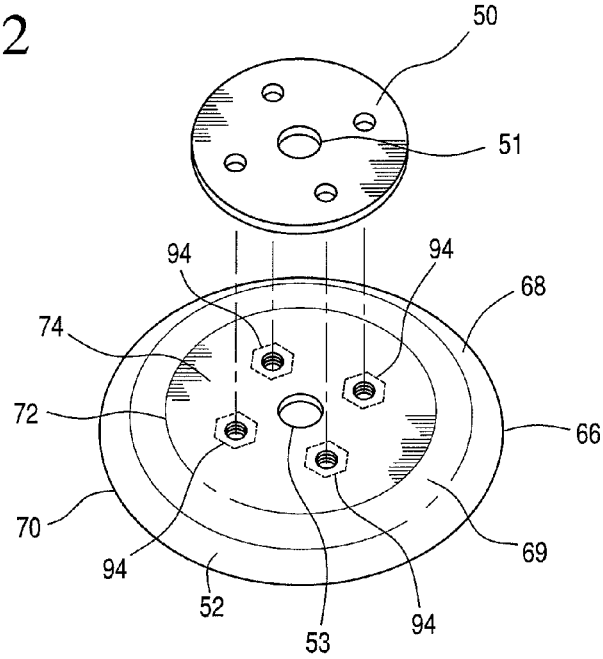
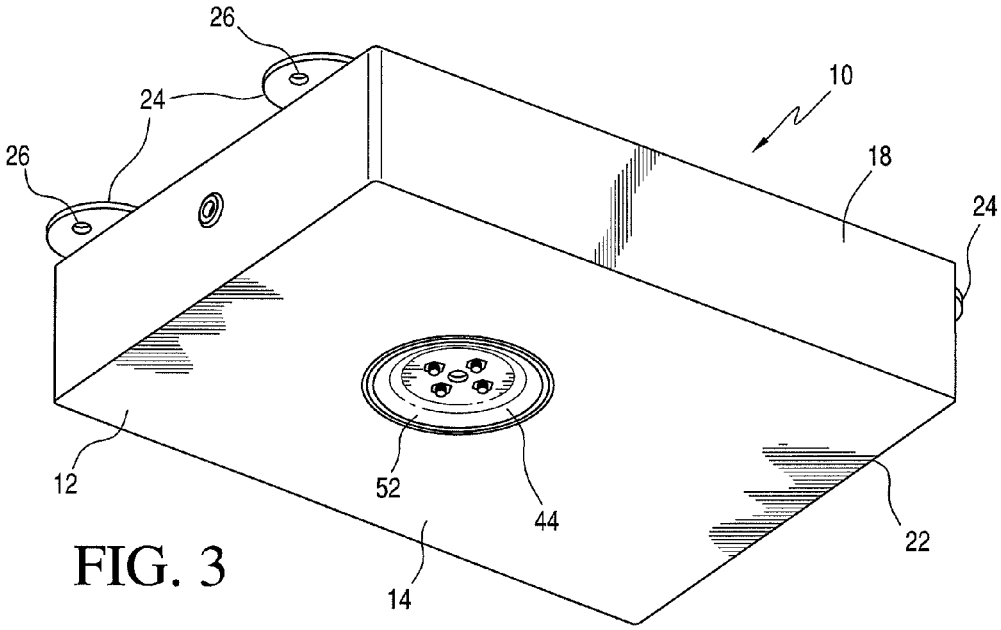
FIG. 3

SPEAKER ASSEMBLY

CROSS REFERENCE TO RELATED APPLICATION

This application claims the benefit of U.S. Provisional Application Ser. No. 61/445,246, entitled "SPEAKER ASSEMBLY", filed Feb. 22, 2011.

BACKGROUND OF THE INVENTION

1. Field of the Invention

The invention relates to a speaker assembly. More particularly, the invention relates to a speaker assembly providing enhanced cooling without compromising sound quality or size considerations.

2. Description of the Related Art

The current global community has made it possible for people from around the country, and around the world, to interact for both business and personal reasons. For many people, this requires they spend considerable time traveling from one location to another location. More often then not, these people travel in aircraft.

Whether these people travel in private or commercial aircraft, they desire high quality entertainment during the many hours they spend within the confines of an aircraft. While high quality entertainment, for example, digital video with CD quality sound, is readily available for theatre and home use, the weight and size requirements for use of such equipment in an aircraft makes it very difficult to incorporate high fidelity systems within an aircraft. This problem is especially pronounced for audio speaker assemblies when one attempts to meet the size, weight and shape requirements for use in aircraft.

The aircraft industry places great priority upon component weight and size reduction. Range and payload are adversely affected by conventional terrestrial designs. These concerns are notable when one attempts to make changes within smaller private jets. For example, a small increase in the weight carried by an aircraft results in a substantial increase in the fuel consumption of the aircraft. In addition, the limited space available within an aircraft dictates the use of any space within the aircraft be carefully considered by those responsible for ensuring the comfort of passengers.

Lightweight and compact audio speakers are currently available. These speakers, however, substantially compromise sound quality for reduction in size and weight. With this in mind, an individual wishing to add an audio system to an aircraft must make a choice between high fidelity speakers, which do not suit the size and weight requirements of the aircraft or lower quality speakers providing desirable size and weight characteristics.

Another concern encountered in the incorporation of speakers within an aircraft is the fact the speakers are generally confined within an enclosed space offering little in the way of airflow for cooling the driving components of the loudspeakers. In addition, the small spaces available within an aircraft also dictate that the speaker housing be relatively small. This further creates heating problems as little air is available within the housing for the cooling of speaker components. As such, speakers are susceptible to overheating, which may result in damage thereto or failure of the component.

More particularly, and as those skilled in the art will certainly appreciate, the voice coil of a conventional driver generates heat which is then dissipated to the surrounding driver structure, that is, the driver magnet, etc. This heat must be "bled off" to maintain the driver at an appropriate operating temperature or the performance of the speaker will be compromised.

A need, therefore, exists for a speaker assembly providing high-fidelity sound, while also accommodating the size and weight constraints of an aircraft. The present invention provides such a speaker assembly.

SUMMARY OF THE INVENTION

It is, therefore, an object of the present invention to provide a speaker assembly including a speaker housing having a substantially closed speaker chamber, the speaker housing including a first wall with a dimple assembly defining a heat sink formed therein. A first driver is mounted and enclosed in the speaker chamber, the first driver including a cone coupled to a driver magnet for generating sound. The driver magnet is in direct contact with the dimple assembly effectively exposing the driver magnet to an exterior of the speaker housing via the heat sink defined by the dimple assembly.

It is also an object of the present invention to provide a speaker assembly wherein the dimple assembly includes an inner first dimple member, a heat transfer spacer member and an outer second dimple member, wherein the heat transfer member is positioned between the inner first dimple member and the outer second dimple member.

It is another object of the present invention to provide a speaker assembly wherein the inner first dimple member includes an inner support surface and the driver magnet is in direct contact with the inner support surface of the dimple assembly effectively exposing the driver magnet to the exterior of the speaker housing via the heat sink defined by the dimple assembly.

It is a further object of the present invention to provide a speaker assembly wherein the inner first dimple member is integrally formed with the first wall, and the inner first dimple member includes a frustoconical sidewall secured to the inner support surface.

It is also an object of the present invention to provide a speaker assembly wherein the frustoconical sidewall is formed with a radius of curvature.

It is another object of the present invention to provide a speaker assembly wherein the frustoconical sidewall includes a wide first end coupled to the first wall and a narrow second end to which the inner support surface is secured.

It is a further object of the present invention to provide a speaker assembly wherein a series of apertures are formed in the frustoconical sidewall.

It is also an object of the present invention to provide a speaker assembly wherein the series of apertures are circumferentially spaced about the frustoconical sidewall.

It is another object of the present invention to provide a speaker assembly wherein the outer second dimple member is shaped to substantially conform to the shape of the inner first dimple member, but is slightly smaller so as to provide space between an outer edge of the outer second dimple member and a wide first end of the inner first dimple member for the flow of air between the outer second dimple member and the inner first dimple member.

It is a further object of the present invention to provide a speaker assembly wherein relative sizes of the outer second dimple member and the inner first dimple member are such that the outer second dimple member sits fully within a space created by the inner first dimple member, and no portion of the outer second dimple member extends beyond a plane in which the first wanes.

It is also an object of the present invention to provide a speaker assembly wherein the outer second dimple member includes a solid frustoconical sidewall with a wide first end and a narrow second end. A plate member is secured to the narrow second end of the solid frustoconical sidewall. The plate member is positioned in contact with the heat transfer spacer member facilitating the transfer of heat from the inner first dimple member.

It is another object of the present invention to provide a speaker assembly wherein at least one screw secures the outer second dimple member, the heat transfer spacer member and inner first dimple member together.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 2 is a detailed view of the spacer member and the outer second dimple member.

FIG. 3 is a bottom perspective view of the speaker assembly.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as the basis for the claims and as a basis for teaching one skilled in the art how to make and/or use the invention.

Figure 1:
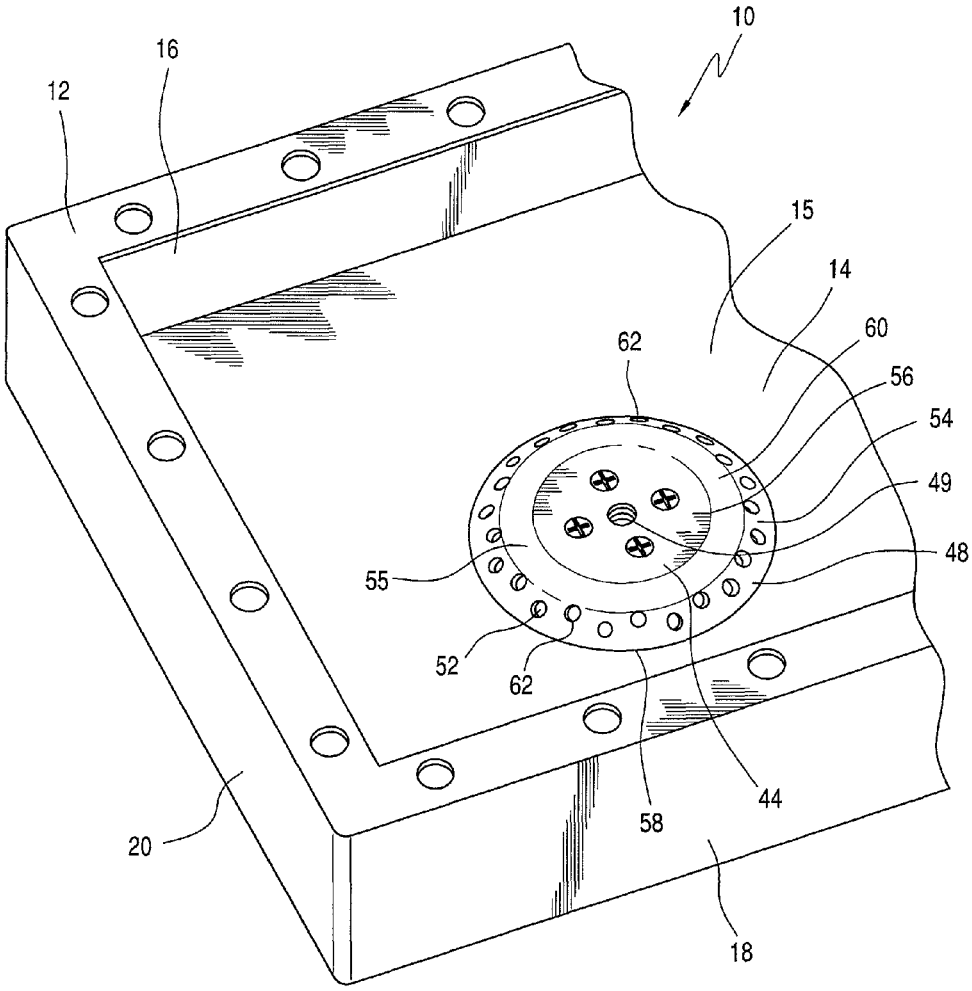
FIG. 1 is a detailed view of the interior of the speaker assembly.
Figure 4:
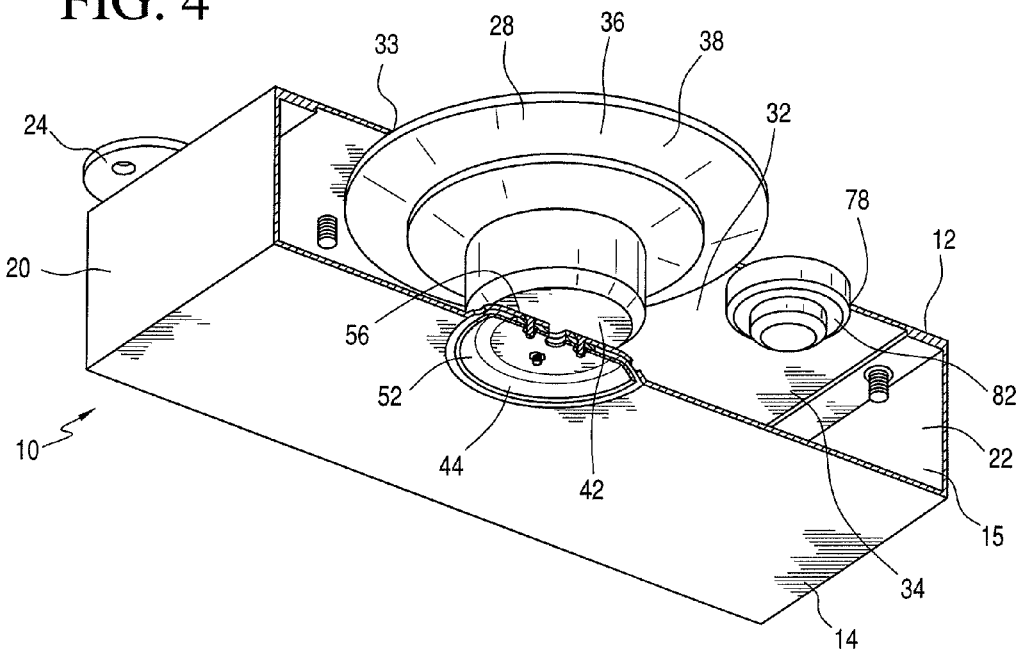
FIG. 4 is a cut-away bottom perspective view.
Figure 6:
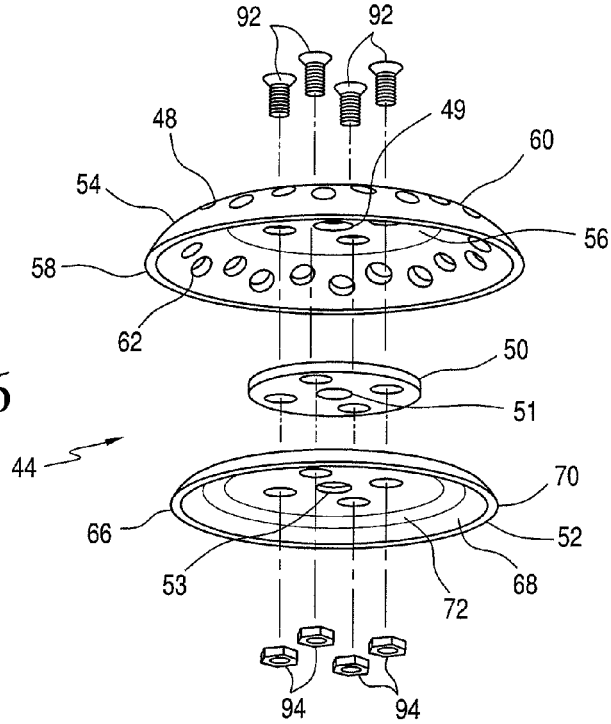
FIG. 6 is an exploded view of the dimple assembly.
Figure 5:
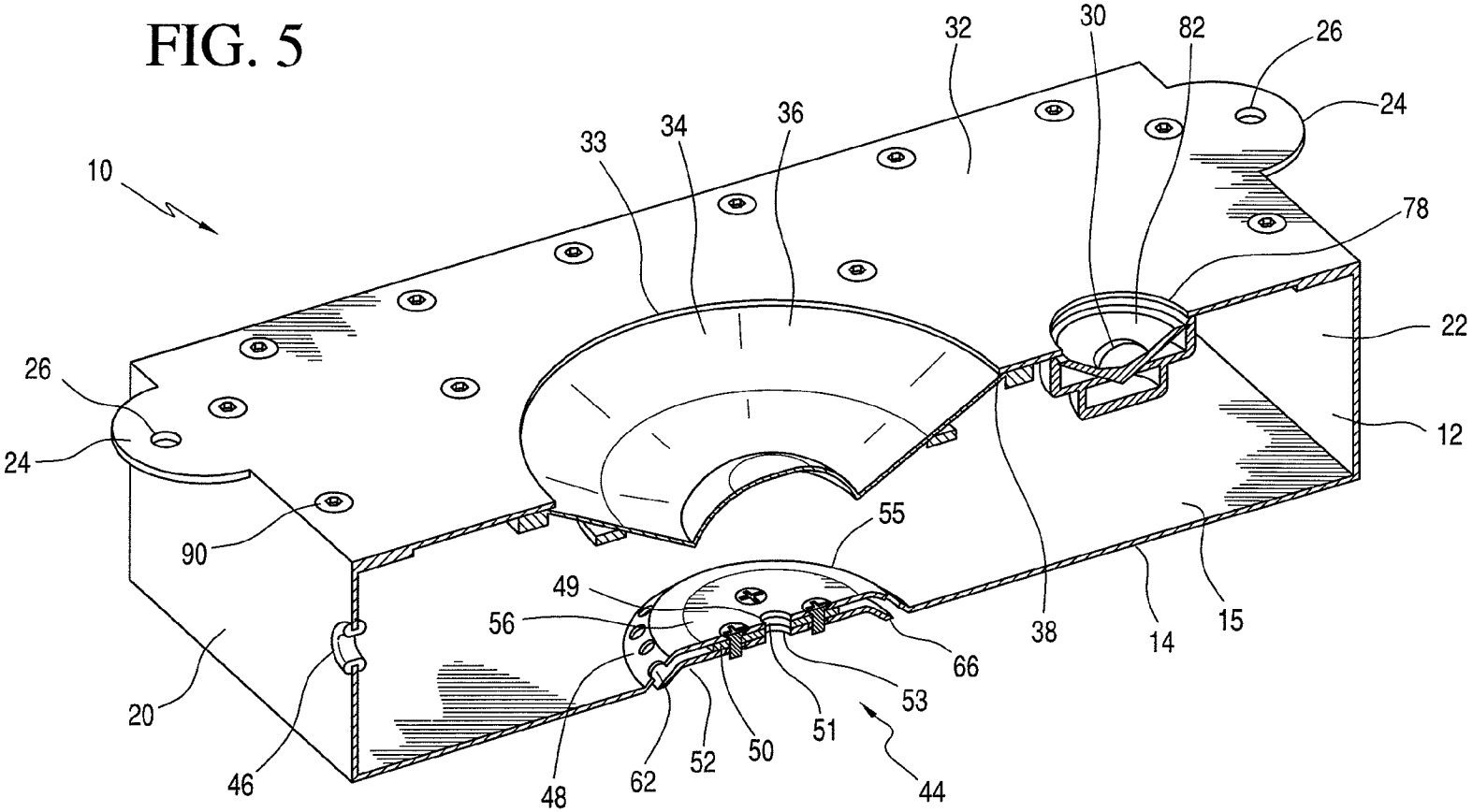
FIG. 5 is a cross sectional view of the speaker assembly with the magnet of the first driver removed for viewing of the dimple assembly.

With reference to FIGS. 1 to 6, a speaker assembly 10 is disclosed. The speaker assembly 10 incorporates various features which reduce the size and weight of the speaker assembly 10 without compromising the integrity of the sound generated by the speaker assembly 10. The speaker assembly 10 also incorporates various features which improve the cooling thereof and ultimate performance of the speaker assembly 10.

The speaker assembly 10 is primarily intended for use in aircraft, where weight and size are critical. While the speaker assembly is preferably designed for use in aircraft, the speaker assembly may be used in a variety of environments, such as wall and closed room speakers, automotive speakers or within personal computers, without departing from the spirit of the present invention.

As will be appreciated, the present speaker assembly 10 has been disclosed without the wiring commonly employed in conjunction with speakers. As such, a variety of conventional wiring techniques may be employed within the spirit of the present invention.

Briefly, the speaker assembly 10 includes a rigid, structurally stable and self supporting speaker housing 12 including a substantially closed speaker chamber 15 within which at least a first driver 28 is mounted and enclosed. The speaker housing 12 includes a dimple assembly 44 formed in a first wall (or closed top wall) 14 of the speaker housing 12. The first driver 28 includes a cone 36 coupled to a driver magnet 42 for generating sound. The driver magnet 42 is in direct contact with the inner support surface 56 of the dimple assembly 44 effectively exposing the driver magnet 42 to the exterior of the speaker housing 12 via the heat sink defined by the dimple assembly 44. That is, although the driver magnet is housed within the speaker housing and is not directly within the external environment, the dimple assembly, which the driver magnet directly contacts, functions as a passageway for the transfer of heat generated by the magnet to the external environment.

More particularly, the driver magnet 42 is supported upon an inwardly directed, convex (when viewed from within the speaker housing) support surface 56 of the dimple assembly 44. The dimple assembly 44 is substantially composed of an inner first dimple member 48, a heat transfer spacer member 50 and an outer second dimple member 52.

The inner first dimple member 48 includes a frustoconical sidewall 54 defining a circumferential rim supporting the inner support surface 56 a spaced distance from the remainder of the closed top wall 14 of the speaker housing 12. The frustoconical sidewall 54 is preferably formed with a slight radius of curvature such that the inner surface 55 of the inner first dimple member 48, that is, the surface facing the speaker chamber 15 exhibits a substantially convex surface. The frustoconical sidewall 54 includes a wide first end 58 coupled to the closed top wall 14 and a narrow second end 60 to which the inner support surface 56 is secured.

The inner support surface 56 is shaped and dimensioned to substantially conform to the profile of the bottom of the driver magnet 42. In this way, the surface area contacting the driver magnet 42 to the inner first dimple member 48 is maximized improving heat transfer as will be appreciated based upon the following disclosure.

A series of apertures 62 are formed in the frustoconical sidewall 54. The apertures 62 are equally spaced about the circumference of the frustoconical sidewall 54 defining a circumferential ring of apertures 62 permitting the flow of air into an out of the closed speaker chamber 15 defined by the speaker housing 12. In accordance with a preferred embodiment of the present invention, approximately 12 apertures 62 are formed about the circumference of the frustoconical sidewall 54 with the apertures 62 positioned at 30° intervals about the circumference of the frustoconical sidewalls 54.

Heat transfer and the controlled pressurization of the closed speaker chamber 15 defined by the speaker housing 12 is achieved by the provision of the outer second dimple member 52 spaced from, but in alignment with, the inner first dimple member 48. Positioned between the inner first dimple member 48 and the outer second dimple member 52 is a heat transfer spacer member 50 optimizing the transfer of heat from the inner first dimple member 48 to the outer second dimple member 52.

The outer second dimple member 52 is shaped to substantially conform to the shape of the inner first dimple member 48. However, the outer second dimple member 52 is slightly smaller so as to provide space between the outer edge 66 of the outer second dimple member 52 and the wide first end 58 of the inner first dimple member 48/closed top wall 14 for the flow of air therebetween.

The sizes of the outer second dimple member 52 and the inner first dimple member 48 are such that the outer second dimple member 52 sits fully within the space created by the inner first dimple member 48. As such, no portion of the outer second dimple member 52 extends beyond a plane in which the closed top wall 14 lies.

As such, the outer second dimple member 52 includes a solid (that is, without the apertures 62 as provided on the inner second dimple member 48) frustoconical sidewall 68 with a wide first end 70 and a narrow second end 72. The frustoconical sidewall 68 is preferably formed with a slight radius of curvature such that the outer surface 69 of the outer second dimple member 52, that is, the surface facing away from the speaker chamber 15 exhibits a substantially convex surface. A plate member 74 is secured to the narrow second end 72 of the frustoconical sidewall 68. The plate member 74 at the narrow second end 72 is positioned in contact with the heat transfer spacer member 50 facilitating the transfer of heat from the inner first dimple member 48. The outer second dimple member 52, heat transfer spacer member 50 and inner first dimple member 48 are secured together by screws 92, which are held in place by nuts 94, extending between the plate member 74 of the outer second dimple member 52 and the inner support surface 56 of the inner first dimple member 48.

Each of the inner first dimple member 48, heat transfer spacer member 50 and the outer second dimple member 52 is provided with a central aperture 49, 51, 53 which provides for cooling of the voice coil (not shown) of the first driver 28.

In accordance with a preferred embodiment, the speaker assembly 10 includes a speaker housing 12 with a base structure composed of a closed top wall 14, closed first and second lateral sidewalls 16, 18 and closed front and rear sidewalls 20, 22. The closed top wall 14 forms a support surface upon which first, or in accordance with a preferred embodiment, mid-range driver 28 is mounted. More particularly, the closed top wall 14 includes the dimple assembly 44, the inner first dimple member 48 thereof that is integrally formed with the closed top wall 14 and which respectively supports the driver magnet 42 of the mid-range driver 28. The dimple assembly 44 is structured as discussed above. Other than the apertures 62 formed within the frustoconical sidewall 54 of the inner first dimple member 48 and the wire port 46 of the speaker housing 12 (which is ultimately closed with a grommet), the closed top wall 14, closed first and second lateral sidewalls 16, 18 and closed front and rear sidewalls 20, 22 are solid and impervious to the passage of sound waves or airflow.

The speaker housing 12 further includes a grill 32 which is selectively secured to the sidewalls 16, 18, 20, 22 to maintain the mid-range driver 28 therein as described below in greater detail. The speaker housing 12 (including the dimple assemblies) is preferably constructed from metals designed to optimize heat transfer. The grill 32 is constructed with a grill port 33 shaped and dimensioned for alignment with the cone 36 of the mid-range driver 28. Other than the grill port 33 (and the high frequency grill port 78 discussed below), the grill 32 is solid and impervious to the passage of sound waves or airflow. In this way, the speaker housing 12 is a substantially closed enclosure with only the grill port 33 permitting the passage of sound emitted by the mid-range driver 28 and the apertures 62 of the respective frustoconical sidewall 54 permitting the passage of air between the closed speaker chamber 15 of the speaker housing 12 and the external environment.

In accordance with a preferred embodiment of the present invention, the closed top wall 14 is substantially rectangular, although other shapes may be employed without departing from the spirit of the present invention. Four mounts 24 respectively extend from their respective ends of the front and rear sidewalls 20, 22. Each corner mount 24 includes an aperture 26 adapted for attaching the speaker assembly 10 within the fuselage of an aircraft. The mounts 24 attach to a mounting bracket (not shown) of the aircraft. The mounting bracket is adapted to facilitate the installation of the present speaker assembly 10 within an aircraft fuselage.

The active components of the speaker assembly 10 include the mid-range driver 28 and the high frequency driver (or tweeter) 30. The mid-range driver 28 is compression fit within the speaker assembly 10. In particular, the mid-range driver 28 is held between the closed top wall 14, in particular, the flat inner support surface 56 of the inner first dimple member 48 and the grill 32 of the speaker assembly 10.

In practice, the grill 32 is bolted to the base structure of the housing 12, in particular, the grill 32 is secured to the exposed edges of the first and second lateral sidewalls 16, 18 and the front and rear sidewalls 20, 22 with screws 90. In this way, the base structure 13 and the grill 32 form an enclosure within which the mid-range driver 28 is held.

The mid-range driver 28 is positioned within the enclosure defined by the grill 32 and the base structure 13 such that the interior surface 34 of the cone 36 is directed toward the grill 32. In fact, the upper edge 38 of the cone 36 has a radius which is in alignment with an outer edge of the grill port 33 formed in the grill 32.

The mid-range driver 28 is compression fit between the flat inner support surface 56 of the inner first dimple member 48 of the speaker housing 12 and the grill 32 such that the interior surface 34 of the cone 36 of the mid-range driver 28 faces the grill 32. The exterior upper edge 38 of the cone 36 is directly attached to the grill 32 along the grill port 33 to provide a port for the transmission of sound. Secure attachment is achieved by using screws or adhesive (or other coupling structures) to securely attach the mid-range driver 28 to the grill 32.

The inner support surface 56 of the inner first dimple member 48 is shaped and dimensioned to support the driver magnet 42 and, ultimately, the mid-range driver 28. The driver magnet 42 is in direct contact with the inner support surface 56. By positioning the inner support surface 56 in direct contact with the driver magnet 42 a heat sink is created where the heat of the driver magnet 42 may be drawn through the inner first dimple member 48 and ultimately to the outer second dimple member 52 exposed to the external environment for effectively dissipating heat generated by the driver magnet 42.

In addition to providing for the cooling of the driver magnet 42 as air passes into and out of the apertures 62 formed within the frustoconical sidewall 54 of the inner first dimple member 48, the proximity of the outer second dimple member 52 to the apertures 62 formed within the frustoconical sidewall 54 of the inner first dimple member 48 controls the flow of air passing therethrough and compression within the speaker housing 12. The ability of compressed air to escape the closed speaker chamber 15 through the apertures 62 formed within the frustoconical sidewall 54 of the inner first dimple member 48 would result in reduced interference between the multiple mid-range drivers as vibrations generated by the mid-range drivers escape the enclosure via the apertures 62. The ability of the present structure to reduce interference between drivers supported within the same enclosure, could be extended to speaker arrays by permitting the mounting of multiple drivers within the same enclosure without worrying that various drivers will interfere with each other.

More particularly, as the mid-range driver 28 would move air into and out of the closed speaker chamber 15 defined by the speaker housing 12 in a manner proportionate to the amplitude of the audio signal being reproduced, it becomes possible to incorporate multiple drivers within the enclosure without creating a compounding effect normally associated with multiple drivers in the same enclosure. The "compounding effect" is a result of the change of air pressure on the unexposed or "backside" of the driver cone which is significantly increased by the presence of one or more additional drivers within the same airspace. Certain frequencies are exaggerated by this effect, always to the detriment of accurate sound reproduction. While it is possible to reduce this effect electrically, doing so adds weight, cost and complexity to the system and does not provide the critical benefit of using the air movement to cool the voicecoil/magnet structure.

It is also contemplated a high frequency driver will be used in conjunction with the present speaker assembly 10. As such, the grill 32 is formed with a high frequency grill port 78 about which the cone 82 of the high frequency driver 30 is secured in a conventional manner.

As discussed above, although the disclosed embodiment shows a speaker assembly with only a first mid-range driver, it is contemplated the speaker assembly may include various drivers, including tweeters and public address drivers, without departing from the spirit of the present invention.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A speaker assembly, comprising:

a speaker housing including a substantially closed speaker chamber, the speaker housing including a first wall with a dimple assembly defining a heat sink formed therein;

a first driver is mounted and enclosed in the speaker chamber, the first driver including a cone coupled to a driver magnet for generating sound;

wherein the driver magnet is in direct contact with the dimple assembly effectively exposing the driver magnet to an exterior of the speaker housing via the heat sink defined by the dimple assembly, and wherein the dimple assembly includes an inner first dimple member, a heat transfer spacer member and an outer second dimple member, wherein the heat transfer member is positioned between the inner first dimple member and the outer second dimple member.

2. The speaker assembly according to claim 1, wherein the inner first dimple member includes an inner support surface and the driver magnet is in direct contact with the inner support surface of the dimple assembly effectively exposing the driver magnet to the exterior of the speaker housing via the heat sink defined by the dimple assembly.

3. The speaker assembly according to claim 2, wherein the inner first dimple member is integrally formed with the first wall, and the inner first dimple member includes a frustoconical sidewall secured to the inner support surface.

4. The speaker assembly according to claim 3, wherein the frustoconical sidewall is formed with a radius of curvature.

5. The speaker assembly according to claim 4, wherein the frustoconical sidewall includes a wide first end coupled to the first wall and a narrow second end to which the inner support surface is secured.

6. The speaker assembly according to claim 3, wherein a series of apertures are formed in the frustoconical sidewall.

7. The speaker assembly according to claim 6, wherein the series of apertures are circumferentially spaced about the frustoconical sidewall.

8. The speaker assembly according to claim 2, wherein the outer second dimple member is shaped to substantially conform to the shape of the inner first dimple member, but is slightly smaller so as to provide space between an outer edge of the outer second dimple member and a wide first end of the inner first dimple member for the flow of air between the outer second dimple member and the inner first dimple member.

9. The speaker assembly according to claim 8, wherein relative sizes of the outer second dimple member and the inner first dimple member are such that the outer second dimple member sits fully within a space created by the inner first dimple member, and no portion of the outer second dimple member extends beyond a plane in which the first wall lies.

10. The speaker assembly according to claim 8, wherein the outer second dimple member includes a solid frustoconical sidewall with a wide first end and a narrow second end, a plate member is secured to the narrow second end of the solid frustoconical sidewall wherein the plate member is positioned in contact with the heat transfer spacer member facilitating the transfer of heat from the inner first dimple member.

11. The speaker assembly according to claim 2, wherein at least one screw secures the outer second dimple member, the heat transfer spacer member and inner first dimple member together.

* * * * *